US005961404A

United States Patent [19]

Gormley

[11] Patent Number: 5,961,404

[45] Date of Patent: Oct. 5, 1999

[54] BAT

[75] Inventor: Ian Gavin Gormley, Durban, South Africa

[73] Assignee: European Sports Merchandising BV, Amsterdam, Netherlands

[21] Appl. No.: 09/021,099

[22] Filed: Feb. 10, 1998

[30] Foreign Application Priority Data

Feb. 14, 1997 [ZA] South Africa ..... 97/1247

[51] Int. Cl.[6] ..... A63B 51/02

[52] U.S. Cl. ..... 473/530; 473/527; 473/524

[58] Field of Search ..... 473/527, 516, 473/524, 530

[56] References Cited

U.S. PATENT DOCUMENTS

| | | | |
|---|---|---|---|
| 3,879,250 | 4/1975 | Rankin, Jr. | 473/527 X |
| 3,934,876 | 1/1976 | Haddad | 473/527 |
| 4,079,935 | 3/1978 | Gormley | 473/530 |
| 4,411,427 | 10/1983 | Baumgartner | 473/530 |
| 4,549,736 | 10/1985 | Lotfy | 473/530 |
| 5,150,896 | 9/1992 | Holmes | 473/530 |

*Primary Examiner*—Raleigh W. Chiu

*Attorney, Agent, or Firm*—Young & Thompson

[57] ABSTRACT

A perforated bat for playing games such as paddle tennis, tether ball and others, has a monolithic unstressed striking head which comprises a pair of outer lattices which form the striking surfaces; and these lattices are joined by a third internal core lattice which has at least one longitudinal and one lateral web spanning the two outer lattices.

13 Claims, 7 Drawing Sheets

BAT

FIELD OF THE INVENTION

This invention relates to a bat for playing games and in particular for playing games such as paddle tennis, tether ball, beach tennis and like games involving tennis balls or the like.

BACKGROUND OF THE INVENTION

It has been recognised that the thickness of such bats is important from the point of rigidity and for a good striking feel but, of course, consideration has to be had to the mass of the bat as well as its balance.

Thus, it has previously been proposed to provide a bat which includes a handle and head, the head including an unstressed monolithic perforated structure and having a pair of spaced-apart lattice structures, the two outer surfaces of which constitute the striking surfaces and the inner surfaces being joined together by a plurality of discrete transverse struts.

In this specification the term "lattice structure" (or lattice) is intended to refer to lattice or grid structures thin in relation to lengths and breadths, which are perforated by a series of openings of a variety of shapes. In a particular form of the invention the structure is a lattice comprising intersecting laths, which may be straight, curved or otherwise shaped and which may intersect at various angles.

In a preferred form of the invention the two spaced apart lattices are formed by intersecting laths and are joined by means of discrete transverse struts spanning corresponding intersections of the laths, as well as the outer frame or rim of the head of the bat which runs around the periphery of the lattices and to which the handle is attached.

Further, according to the invention, some of the interstices in the latticed striking surfaces may be webbed and it is further preferred that alternative interstices be webbed to constitute a checkered pattern.

This bat has a striking head which can be described as being of double lattice construction—the outer faces of the two lattices constituting the striking faces.

This construction enables the head of the racket to be relatively thick in construction, much of the rigidity being imparted by the depth or width of the "frame" running around the periphery of the striking head.

The interior of the bat is relatively hollow—apart from the internal cross struts and is therefore relatively light. A bat of this construction is covered by U.S. Pat. No. 4,411,427.

OBJECT OF THE INVENTION

It is an object of the present invention to provide a perforated bat which has better rigidity than that provided by bats of double lattice design as described above.

THE INVENTION

According to the invention there is provided a bat incorporating a monolithic unstressed striking head having a pair of spaced apart outer lattices, the outer surfaces constituting the striking surfaces of the head, the two outer lattices being joined by a third internal "core lattice" covered and protected by the two outer lattices.

In this specification the term "core lattice" is intended to include a structure comprising at least one longitudinal and one lateral element spanning the striking head of the bat and making up, with the outer rim of the bat, such "core lattice".

However, the term core lattice may also include structures consisting of elements spanning the striking head running in one direction only, so that they do not intersect each other and may also include a structure with only one such element spanning the striking head.

The core lattice will be characterised by having relatively few elements making up such core lattice compared with the two outer lattices.

In a preferred form of the invention, the outer lattices will not include interstices or gaps more than 25 mm in size measured in any direction across such interstices, so as to reduce uneven ball "bounce" on impact. The elements of the core lattice however, may include interstices between such elements which are preferably at least 40 mm in size.

Another characteristic of this invention is that the webbed sections of the internal elements making up the core lattice are relatively thin compared to the elements making up the outer lattices.

In the preferred form of the invention the laths making up of the outer lattices will be of the order of at least 1.5 mm to 2 mm thick in order to be strong enough to resist damage when striking a ball in play. The thickness of the webbed sections of the internal core lattice will however, be substantially thinner, being of the order of approximately 0.75 mm.

In a preferred form of the invention the core lattice includes at least two longitudinal and two lateral elements.

These latter elements may coincide with intersections of the two outer lattices and may be symmetrically located with respect to the head structure.

Other intersections of the spaced-apart outer lattices may be joined by means of discrete transverse struts and it will be appreciated that the elements may coincide with certain rows of struts and, in fact, the elements may comprise rows of struts with connecting webs there-between. The webs may be of the order of 0.75 mm so that the mass of the bat is kept to a minimum.

One of the design features of bats of this type is that the design of the two outer lattices is robust and strong enough to resist any damage caused in striking balls in play. However, these outer lattices protect and cover the elements of the core lattice which, although relatively thin, imparts great extra rigidity to the bat. If the elements of the core lattice were not so protected by the outer lattices, they would soon suffer damage not only because of their relative thinness but also because they are normally relatively widely spaced apart, and therefore would be susceptible to damage caused by blows from a ball which would be able to impart sideways stress to the elements, because the ball would penetrate quite deeply below the level of the plane of the outer edges of the lattice being struck and thus impinge against the sides of the elements rather than the edges.

In a preferred form of the invention the core lattice includes a zone bounded by elements of the core lattice at the centre or sweetspot of the bat thereby providing additional rigidity and strength in this zone. It was surprisingly found that this zone may also be responsible for a distinctive different characteristic impact sound. There may be a difference in pitch, when a ball is struck in this central area, compared with other areas of the bat head outside of this central zone.

It appears that the pitch of such sound depends on the area of the central zone bounded by elements of the core lattice and similarly the pitch of the impact sound, when the ball strikes an area outside of the central zone, may also depend on the areas bounded by the elements of the core lattice (and possibly the surrounding rim) in these outer areas.

A variation of the invention is for additional elements to be introduced in the central zone area so as to break this area up into relatively small zones, compared with zones in the outer areas which result in the impact sound being relatively high in pitch when a ball strikes this area.

The elements spanning the central zone will not span the whole head of the bat but only the chosen area of the central zone.

The lattices of the striking surfaces are preferably alternatively webbed to create in checkered pattern with the webs on one surface being staggered in relation to those of the opposite surface.

It has also been found that the webbed sections of the elements of the core lattice, lying between the internal cross struts connecting the two outer lattices, may be provided with one or more holes or apertures in the centre of such webbed sections, which saves weight and does not significantly affect the structural strength or rigidity of the element.

Such holes or apertures also provide bearing surfaces which touch and support the adjacent neighbouring structures of the mold in its closed position while the bat is being moulded, thereby contributing to the longevity of the tooling which produces the bat.

A preferred form of the invention provides for one or more holes or apertures in the centre of each webbed section of the elements of the core lattice.

EMBODIMENT OF THE INVENTION

An embodiment of the invention is described below with reference to the accompanying drawings in which.

The bat of the invention has a pair of spaced apart striking surfaces 10 of webbed lattice construction. The surfaces may be regarded as being a lattice construction with alternate gaps 11 being webbed and in the embodiment, the resulting gaps are octagonal having four long and four short sides.

The inner surfaces of the two outer lattices are joined and their intersections of the lattices by means of internal cross struts 12.

Figure 1:
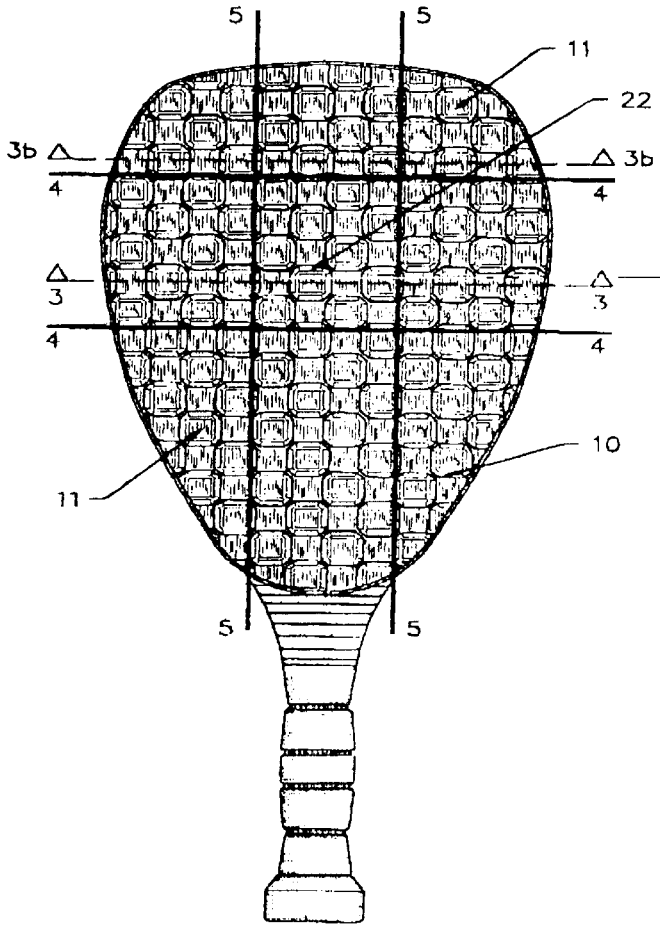
FIG. 1 is a plan view bat according to the invention.
Figure 2:
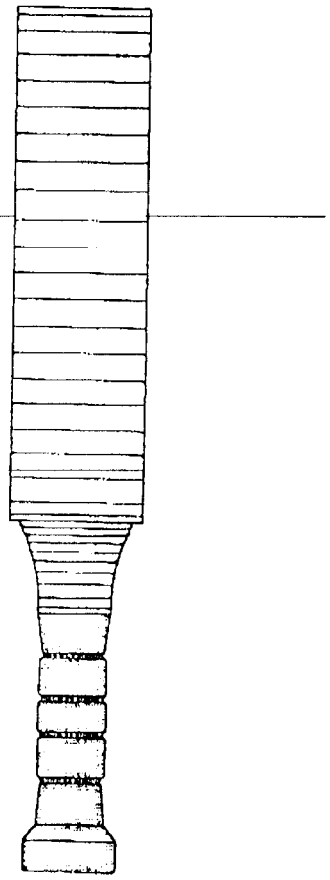
FIG. 2 is a side view.
Figure 3:
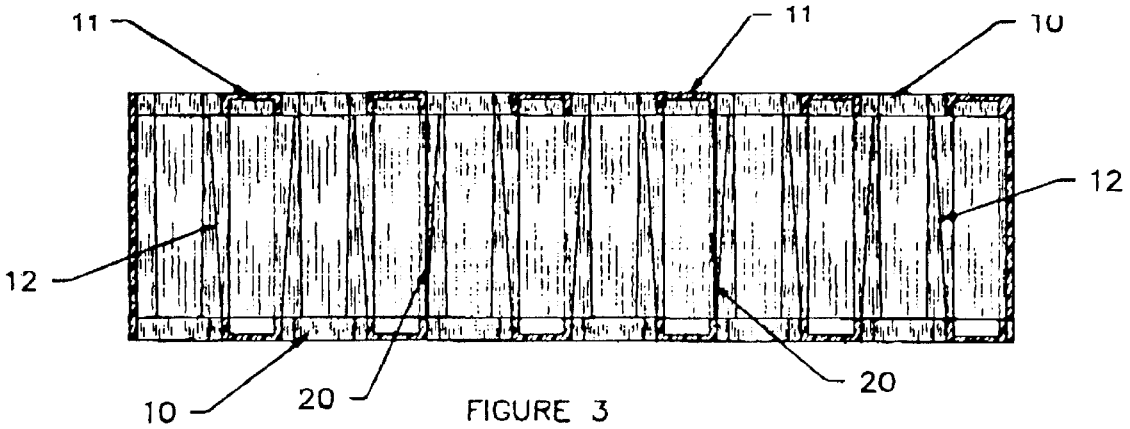
FIG. 3 is a section along the lines 3—3 of FIG. 1.
Figure 4:
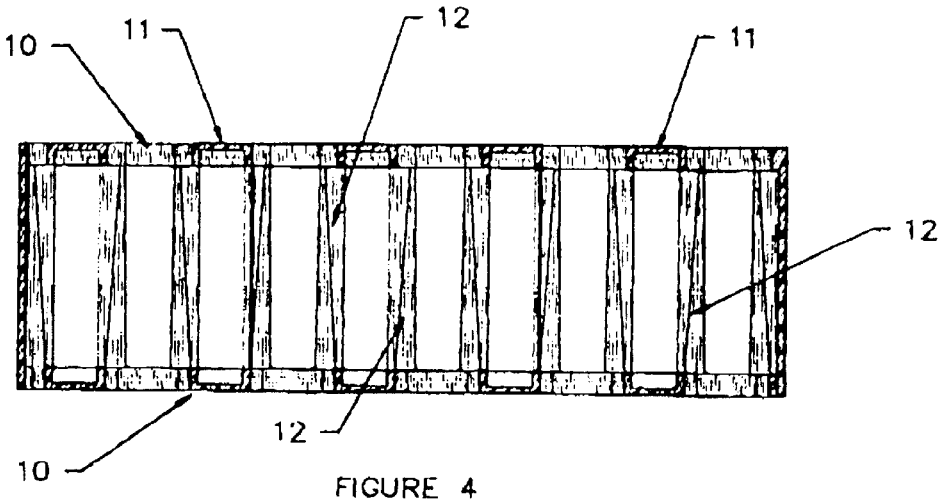
FIG. 4 is a section along the lines 3B—3B of FIG. 1.
Figure 5:
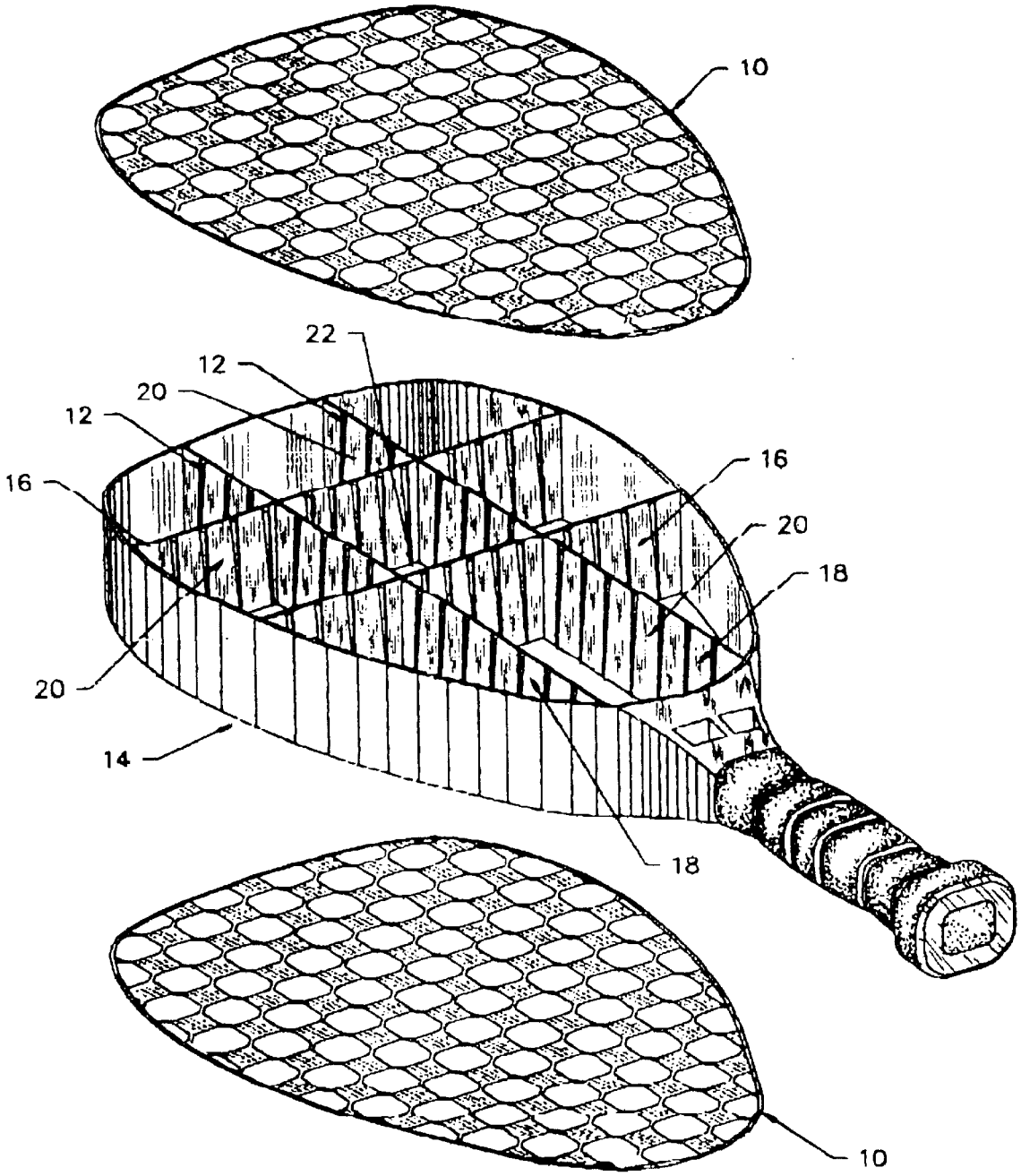
FIG. 5 is a simplified three dimensional exploded view of the bat showing the three lattices but excluding for clarity, the internal cross struts except where integral with the inner lattice.
Figure 6:
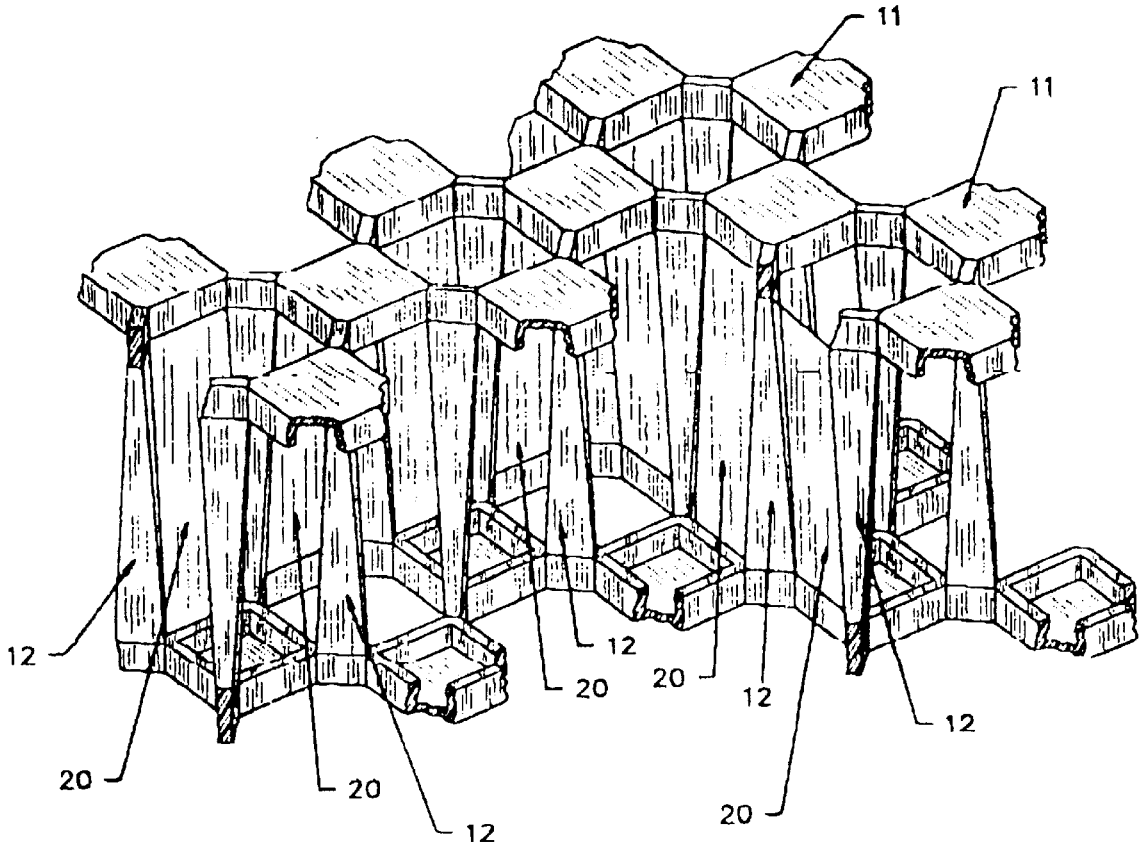
FIG. 6 is a partial isometric view of a broken away section of the bat according to the invention.
Figure 8:
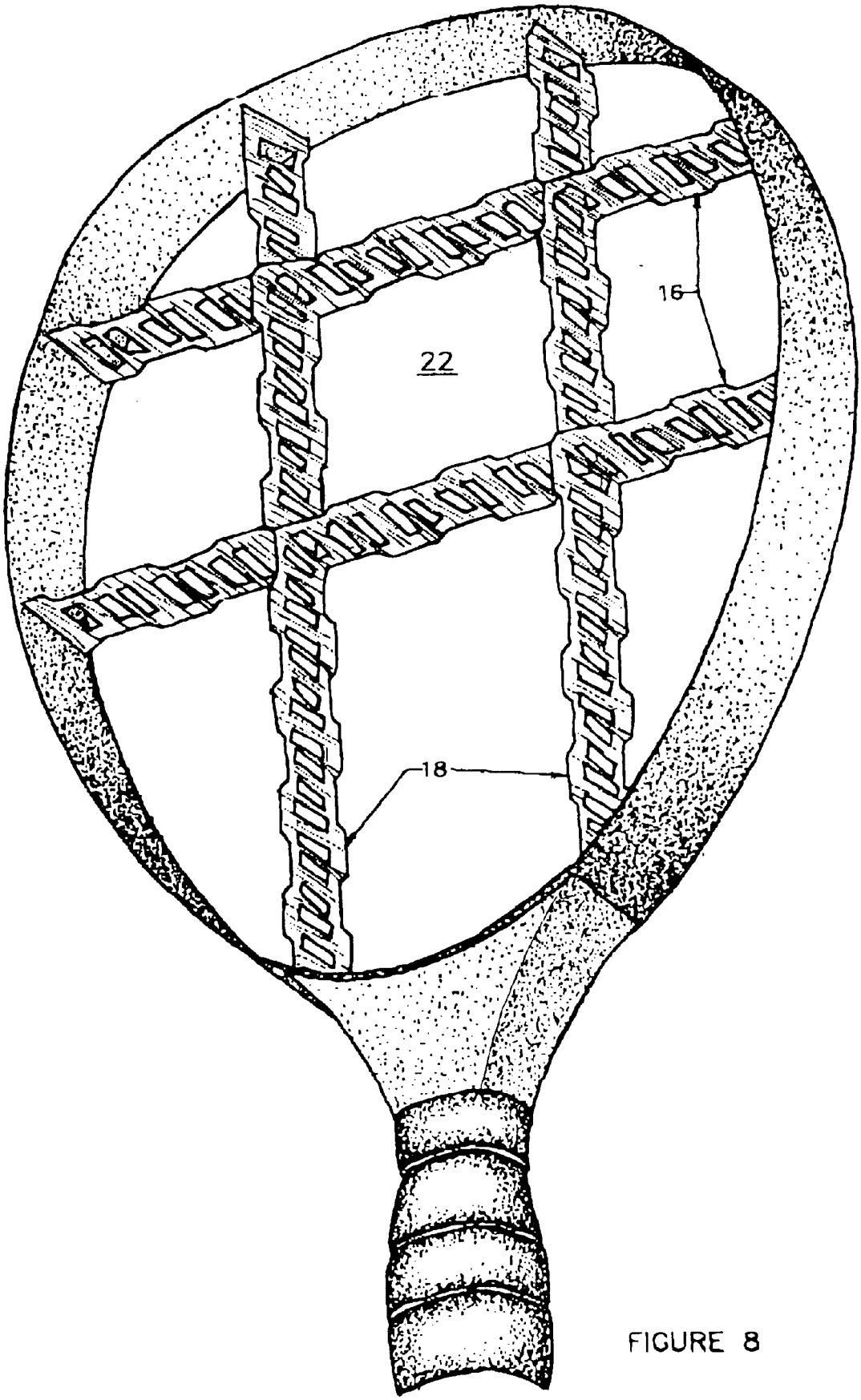
FIG. 8 is an isometric view of a partial bat illustrating the internal core lattice, without the outer two lattices.
Figure 9:
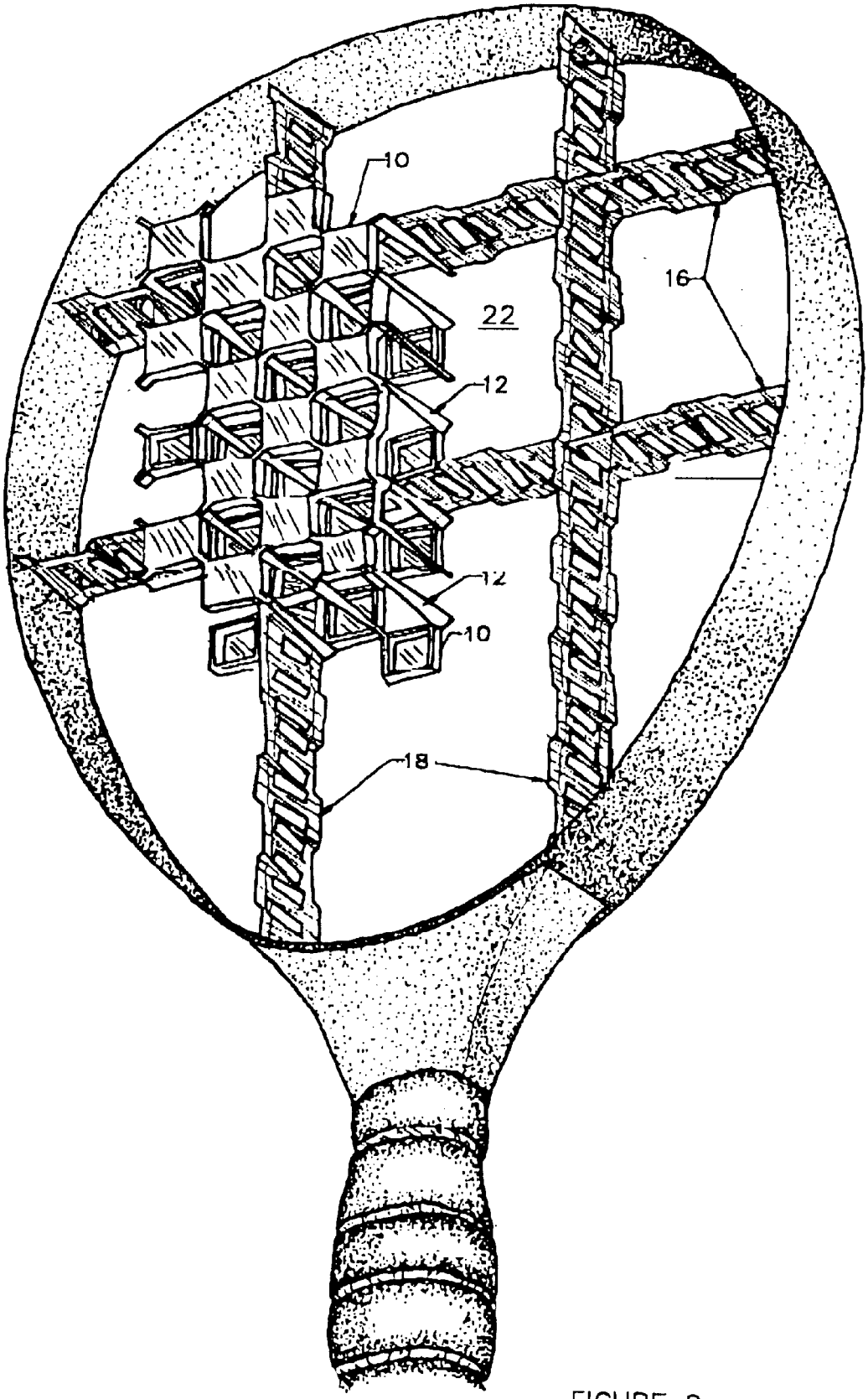
FIG. 9 is a similar view with the addition of a broken-away structure of the two outer lattices and the internal core lattice.

A core lattice 14 inside the two outer lattices 10 is provided by internal transverse spars 16 running inside the two outer lattices along the lines 4—4 of FIG. 1 and longitudinal spars 18 along the lines 5—5 of FIG. 1 and as shown in FIGS. 5, 8 and 9.

The intersections of the longitudinal and the transverse spars defines a zone 22 which covers the central area of the striking surfaces thereby particularly reinforcing the bat where a ball is usually struck, and creating a characteristic impact sound.

Figure 7:
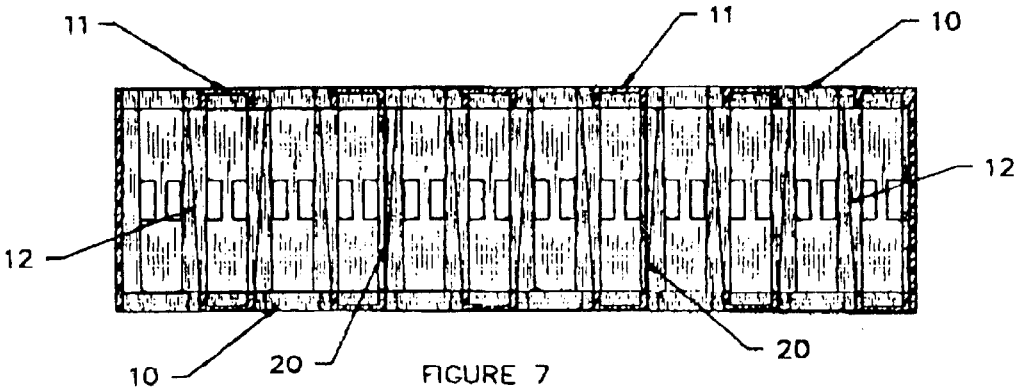
FIG. 7 is a similar view to FIG. 3 of a refinement of the invention.

In FIG. 7 the webs 20 have orifices 50 which save on mass and cost of the bat without affecting its structural strength or rigidity. These orifices also serve to provide bearing surfaces which touch and support the adjacent neighbouring structures of the mould in its closed position while the bat is being moulded, thereby contributing to the longevity of the tooling which produces the bat.

It will be appreciated that one or more such orifices may be provided.

In FIG. 8 the basic skeleton of a bat is illustrated and in FIG. 9 a portion of the two outer lattices is shown on either side of the core lattice comprising spars 16 and 18.

Figure 10:
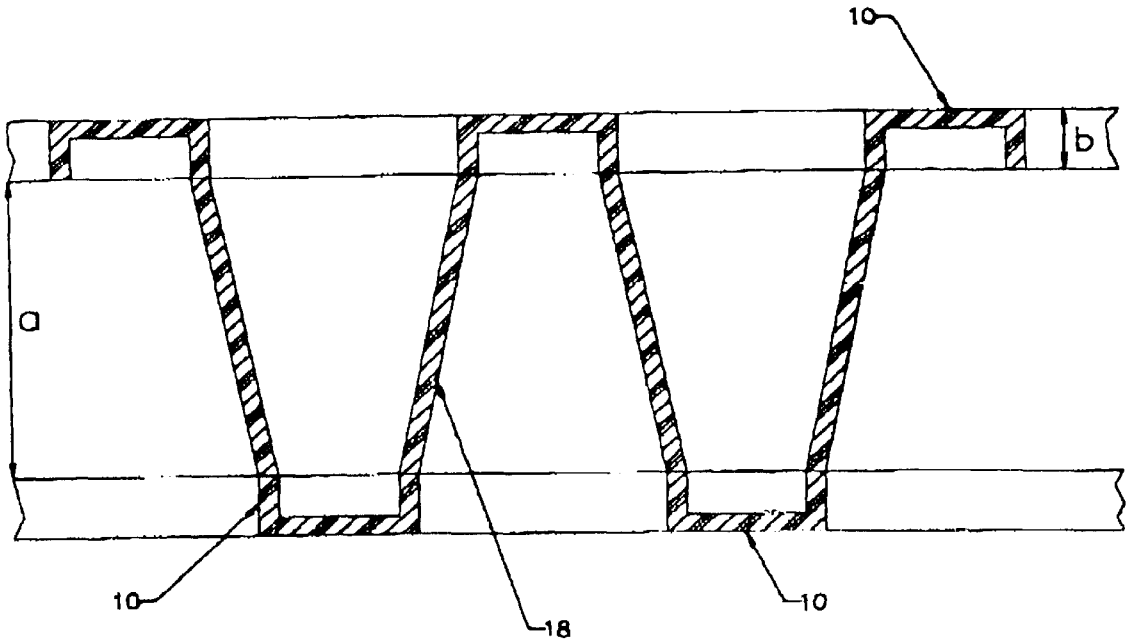
FIG. 10 is a sketch in enlarged sectional side view of a very small portion of the bat to illustrate the nature of the core lattice.

In FIG. 10 a portion of the inner core lattice 18 is illustrated showing its relative width a in relation to the depth b of the outer lattices 10.

What is claimed is:

1. A bat incorporating a monolithic unstressed striking head, having a pair of spaced-apart outer lattices, the outer surfaces of which constituting the striking surfaces, the two outer lattices being joined by a third internal core lattice covered and protected by the two outer lattices.

2. The bat according to claim 1 in which the core lattice has relatively few elements making up such core lattice compared with the two outer lattices.

3. The bat according to claim 1 in which the outer lattices have interstices less than 25 mm measured in any direction across such interstices.

4. The bat according to claim 3 in which the elements of the core lattice are at least 40 mm apart.

5. The bat according to claim 3 in which the laths making up the outer lattice are of the order of at least 1.5 m to 2 mm thick.

6. The bat according to claim 1 in which the webbed sections of the internal elements making up the core lattice are relatively thin compared to the elements making up the outer lattices.

7. The bat according to claim 2 in which the core lattice includes at least two longitudinal and two lateral elements.

8. The bat according to claim 7 in which the elements coincide with intersections of the two outer lattices and are symmetrically located with respect to the head structure.

9. The bat according to claim 8 in which other intersections of the outer lattices are joined by means of discrete transverse struts.

10. The bat according to claim 9 in which the elements coincide with certain rows of struts and the elements comprise such rows of struts with connecting webs therebetween.

11. The bat according to claim 10 in which the webs are of the order of 0,75 mm in width.

12. The bat according to claim 11 in which the core lattice includes a square or rectangular zone bounded by elements of the core lattice at the centre or sweetspot of the bat.

13. The bat according to claim 1 in which the interstices of the outer lattices are alternatively webbed to create a checkered pattern.

* * * * *